United States Patent [19]

Ueno et al.

[11] 4,387,980

[45] Jun. 14, 1983

[54] CHARGING DEVICE FOR ELECTRONIC COPIER

[75] Inventors: Tsuyoshi Ueno, Fujisawa; Hideo Mukai, Yokohama; Yoshitsugu Nakatomi, Yokohama; Hiroshi Saito, Yokohama; Koichi Kinoshita, Narashino; Takaaki Konuma, Shizuoka, all of Japan

[73] Assignee: Tokyo Shibaura Denki Kabushiki Kaisha, Kawasaki, Japan

[21] Appl. No.: 218,444

[22] Filed: Dec. 19, 1980

[30] Foreign Application Priority Data

| | | | |
|---|---|---|---|
| Dec. 25, 1979 | [JP] | Japan | 54-168535 |
| Jan. 23, 1980 | [JP] | Japan | 55-6658[U] |
| Jan. 24, 1980 | [JP] | Japan | 55-7349 |
| Jan. 24, 1980 | [JP] | Japan | 55-7350 |
| Jan. 24, 1980 | [JP] | Japan | 55-7493[U] |
| Jan. 24, 1980 | [JP] | Japan | 55-7494[U] |

[51] Int. Cl.[3] ..... G03G 15/00; G03G 15/16

[52] U.S. Cl. ..... 355/3 CH; 355/14 C; 355/3 R; 355/14 R; 430/31; 430/35; 118/625; 118/651

[58] Field of Search ..... 355/3 CH, 14 C, 3 R, 355/14 R; 430/125, 55, 126, 902, 122, 31, 35; 118/625, 621, 651, 652

[56] References Cited

U.S. PATENT DOCUMENTS

| | | | |
|---|---|---|---|
| 3,146,385 | 8/1964 | Carlson | 118/651 X |
| 3,551,313 | 12/1970 | Walsh | 430/35 |
| 3,684,364 | 8/1972 | Schmidlin | 355/3 CH |
| 3,784,294 | 1/1974 | Wells | 430/35 X |
| 4,077,709 | 3/1978 | Borostyan et al. | 355/3 CH X |
| 4,166,690 | 9/1979 | Bacon et al. | 355/3 CH |
| 4,190,348 | 2/1980 | Friday | 355/3 CH X |
| 4,259,003 | 3/1981 | Mangal et al. | 355/3 CH |
| 4,265,998 | 5/1981 | Barkley | 355/3 CH X |

*Primary Examiner*—A. C. Prescott

*Attorney, Agent, or Firm*—Cushman, Darby & Cushman

[57] ABSTRACT

In an electronic copier provided with a light-sensitive medium, a charging station, an exposure station, a developing station, a transfer station and a fixing unit, the charging station includes a plurality of contact charging elements in contact with the light-sensitive medium and a voltage supply means for applying voltages to the contact charging elements. A voltage continuously rising in a predetermined period of time is supplied from the voltage supply means to the contact charging elements with the rotation of light-sensitive medium, and the light-sensitive medium is thus uniformly charged.

14 Claims, 18 Drawing Figures

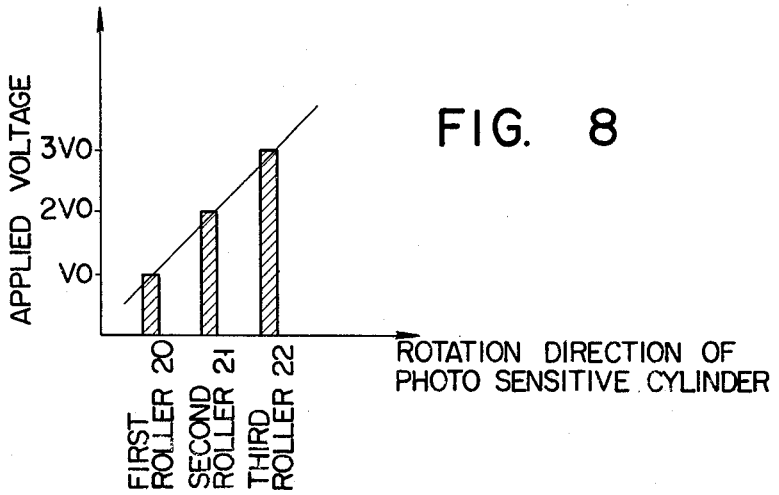
FIG. 8
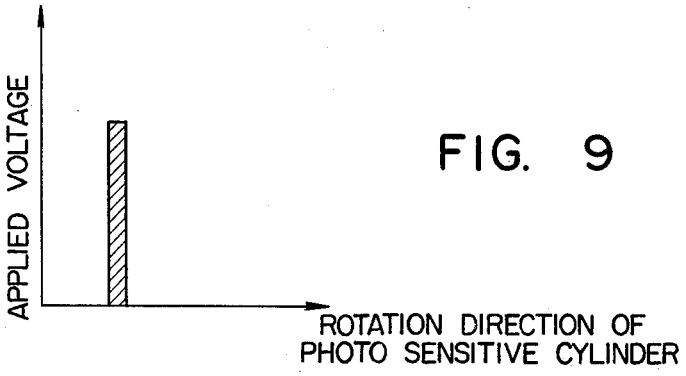
FIG. 9
FIG. 10
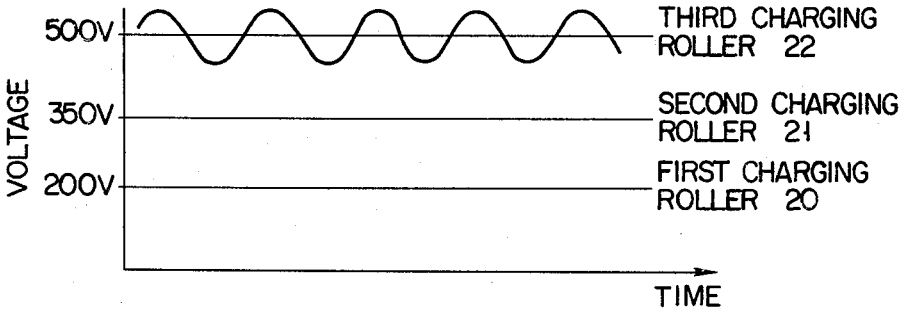

CHARGING DEVICE FOR ELECTRONIC COPIER

BACKGROUND OF THE INVENTION

This invention relates to electronic copiers and, more particularly, to improvements in the charging device in the electronic copiers.

In the electronic copier, a light-sensitive medium is precharged by a precharger prior to the exposure thereof to a light image of an original as is well known in the part.

The prior-art prechargers include a corona charger making use of the corona discharge and a contact charging means which effects charging of light-sensitive with a conductive brush or a conductive roller in forced contact with the medium. The corona charger is simple in construction and has steady performance. However, it uses a high voltage source of 5 to 10 kv, and therefore it has drawbacks in safety and economy. Further, during the corona discharge ozone is produced and extremely deteriorates the properties of the light-sensitive medium, developer and other materials. The contact charging means requires a low voltage source of only 0.5 to 1 kV, and hence it is free from the generation of ozone. On the demerit side of this means, however, it is difficult to continuously obtain uniform charging, and the reliability is low. With this means, the voltage required for the charging of the light-sensitive medium is applied in one step in the form of a pulse, and a maximum voltage is applied at the point of commencement of contact between the light-sensitive medium and conductive brush or conductive roller. Therefore, a sharp charge of applied voltage occurs at the commencement of contact, and uniform charging of the light-sensitive medium cannot be obtained.

In addition, the light-sensitive medium is liable to be electrically damaged.

SUMMARY OF THE INVENTION

An object of the invention is to provide a charging device for an electronic copier, with which a plurality of contact charging elements are held in contact with light-sensitive medium to permit a continuous uniform charging performance to be obtained with application of different voltages from a voltage source to these contact charging elements, and also which is highly safe and economical.

To achieve the above object, the electronic copier according to the invention comprises a light-sensitive medium, a charging means including a plurality of contact charging elements in contact with the light-sensitive medium, a voltage supply means for supplying different voltages to the respective contact charging elements, an exposure means for forming an electrostatic latent image of a light signal on the light-sensitive means, a means for transferring a visible image formed on the light-sensitive medium onto a recording sheet, a means for fixing the visible image transferred onto the recording sheet, and a means for cleaning the light-sensitive medium.

The above and other objects and features of the present invention will be apparent from the following description taken in connection with the accompanying drawings, in which:

BRIEF DESCRIPTION OF THE DRAWINGS

FIG. 8 is a view showing the way, in which voltages are supplied;

FIG. 9 is a view showing the prior art way of supplying voltage;

FIG. 10 is a waveform chart showing voltage outputs from a voltage supply means in another embodiment of the invention;

DETAILED DESCRIPTION OF THE PREFERRED EMBODIMENT

Figure 1:
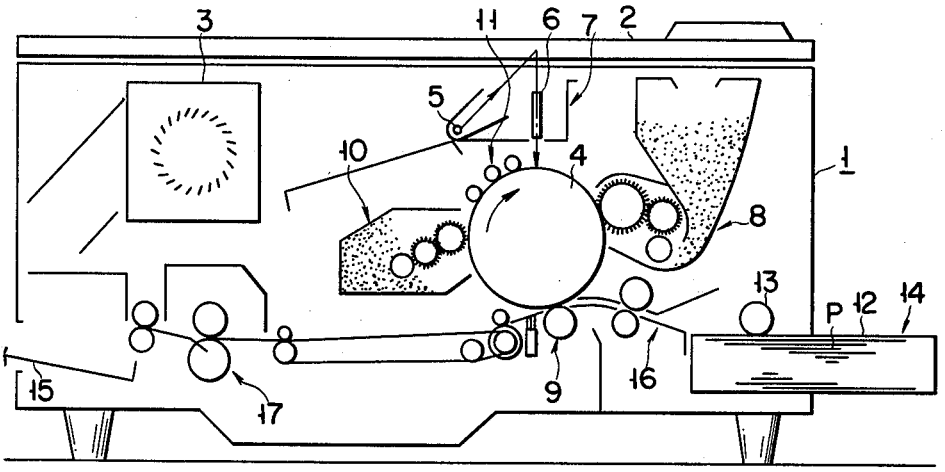
FIG. 1 is a schematic longitudinal sectional view showing an electronic copier embodying the invention.

FIG. 1 is a schematic longitudinal sectional view of an embodiment of the electronic copier according to the invention. Designated at 1 is a frame of the copier, on the top of which an original underlay 2 is provided. The original underlay 2 is adapted to be reciprocated from a drive motor 3 provided within the frame 1. Substantially in the center of the frame 1, a light-sensitive medium 4 consisting of a resin dispersoid in lead oxide in the form of a drum is supported. An exposure system 7 including a lamp 5 and an optical fiber lens 6 is provided between the light-sensitive medium drum 4 and original underlay 2. It is adapted to illuminate an original held on the original underlay 2, and light reflected by the original is led to the light-sensitive medium drum 4 and focused thereon as a light image of the original. A developing station 8, a transfer station 9, a cleaning station 10 and a charging station 11, which will be described hereinafter in detail, are provided in the mentioned order along the drum 4 in the direction of rotation thereof from the focusing position mentioned above. The developing station 8 serves to develop a latent image of the original that is formed on the surface of the drum 4 by the function of the exposure system 7, thus obtaining a visible image. The cleaning station 10 serves to remove residual toner from the surface of the drum 4. The bottom of the frame 1 is provided with a sheet supply unit 14 including a removably mounted sheet cassette 12 accommodating a plurality of copying sheets P and sheet feed roller 13 for feeding out the copying sheets P one after another. A copy tray 15 is provided on the frame 1 on the side of the transfer station 9 opposite the sheet supply unit side, and a sheet feed path 16 consisting of rollers and guide plates is provided between the sheet supply unit 14 and tray 15. Each copying sheet P supplied from the sheet supply unit 14 is fed along the sheet feed path 16 to pass between the light-sensitive medium drum 4 and transfer station 9 for the transfer of the original image onto it and then be exhausted to the copy tray 15. A fixing unit 17 is provided to face the feed path 16 between the transfer station 9 and tray 15. It serves to fix the original image transferred onto the copying sheet P.

The charging station 11 will now be described in detail.

Figure 2:
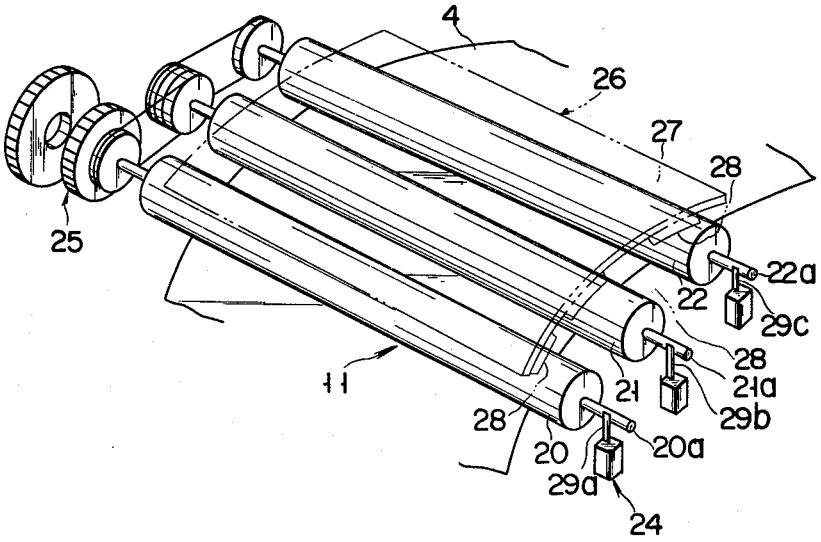
FIG. 2 is a perspective view showing an embodiment of the charging device for an electronic copier according to the invention.

As shown in FIG. 2, it includes first to third charging rollers 20 to 22, which are contact charging elements, and a power supply means 24 for applying different voltages to the first to third charging rollers 20 to 22. The charging rollers 20 to 22 are conductive rollers made of, for instance, urethane foam and having the same diameter. They are arranged in rolling contact with the periphery of the light-sensitive medium drum 4 at a predetermined interval in the direction of the rotation of the drum 4, and they have a certain interval of contact with the drum periphery. They are coupled to a drive mechanism 25 consisting of gears, pulleys and belts such that they can be rotated in the same direction. Designated at 26 is a roller cleaning means having a plate 27 carrying brushes 28, which are in frictional contact with the respective charging rollers 20 to 22 for removing residual toner therefrom.

The power supply means 24 includes power supply brushes 29*a* to 29*c* engaging and electrically connected to the respective charging rollers 20 to 22. These brushes are connected to an electric circuit to be described later.

Figure 3:
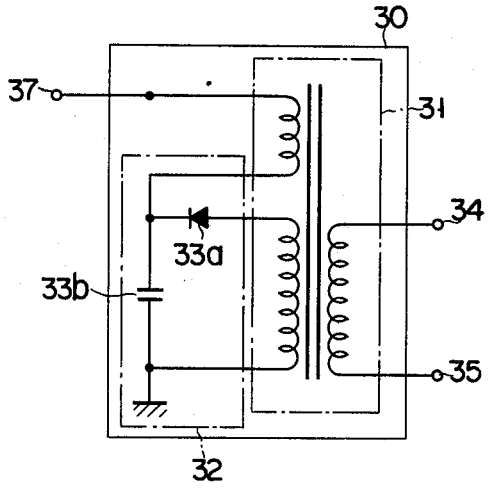
FIG. 3 is a circuit diagram showing a power source unit as voltage supply means.
Figure 4:
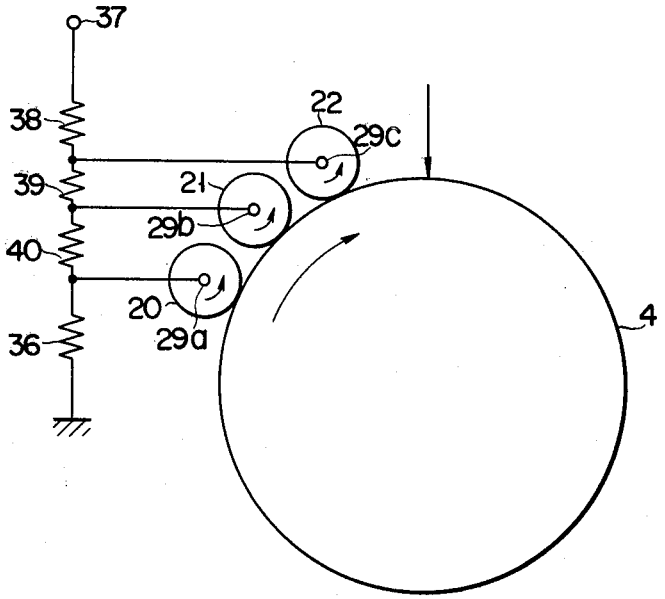
FIG. 4 shows an electric circuit for applying different voltages to the charging station.

FIG. 3 shows a power source unit 30 for supplying voltage to the power supply brushes 29*a* to 29*c*. It includes an iron-core resonant transformer 31 and a rectifying circuit 32. The rectifying circuit 32 has a diode 33*a* and a capacitor 33*b*. With AC voltage applied between input terminals 34 and 35, the transformer 31 provides an output voltage at an output terminal 37. The output voltage is supplied to the rectifying circuit 32, and a DC voltage output therefrom is coupled to the output terminal 37. The output terminal 37 is electrically connected to the first to third charging rollers 20 to 22 as shown in FIG. 4.

Figure 5:
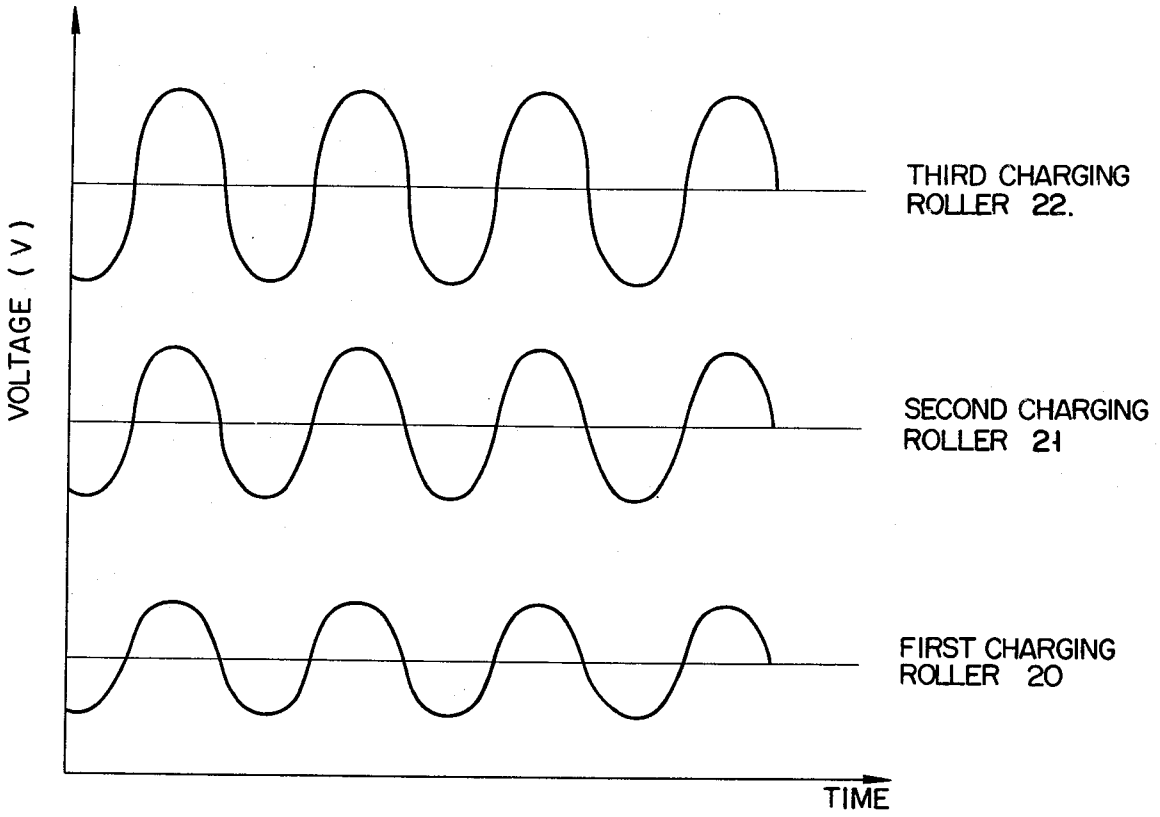
FIG. 5 is a waveform chart showing the output voltages from the electric circuit shown in FIG. 4.
Figure 6:
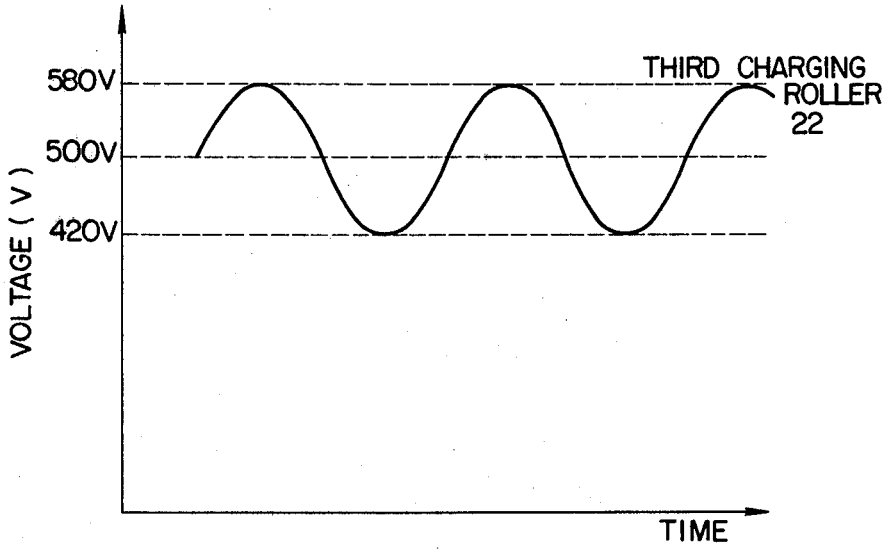
FIG. 6 is a waveform chart showing the voltage applied to the third charging roller.

As is shown, the output terminal 37 is grounded through a plurality of series resistors 38, 39, 40 and 36, and the power supply brushes 29*a* to 29*c* mentioned above are connected to this series resistor circuit. With this electric connection, voltages as shown in FIG. 5 are applied to the first to third charging rollers 20 to 22; more particularly, voltages increasing stepwise, namely about 200 V, about 350 V and about 500 V, are applied to the respective first to third charging rollers 20 to 22. These voltages each contain a DC component and an AC component superimposed thereupon and with a peak-to-peak value of about 20% of the DC voltage. In case of, for instance, the third charging roller 22, the voltage applied consists of a DC component of about 500 V and an AC component of about 80 V superimposed thereupon, as shown in FIG. 6. As a result of experiments, it has been found that if the AC component is greater than 100 V, fluctuations of charging are produced in the direction at right angles to the direction of rotation of the light-sensitive medium drum 4 and appear as a form of fringes, while if it is less than 50 V the effect of recovering the fatigue due to repeated use cannot be obtained. Thus, the best range of the AC component to be superimposed is between about 80 V and about 100 V.

Figure 7:
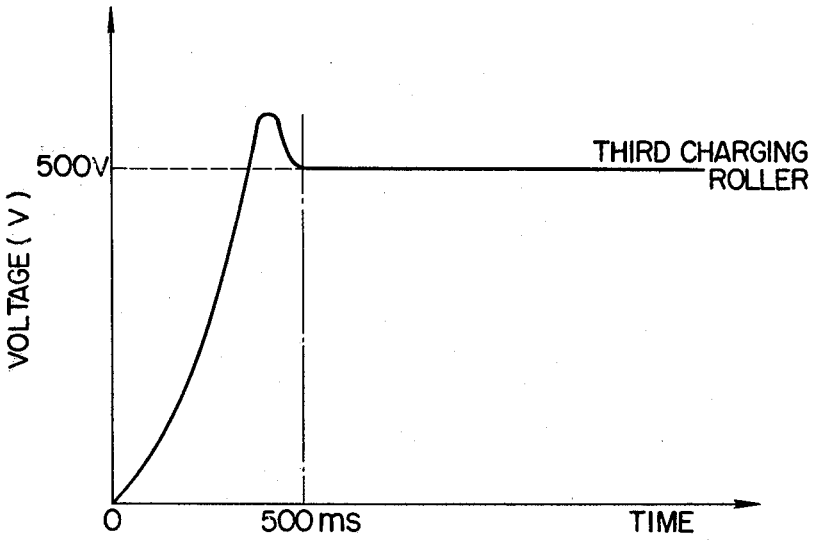
FIG. 7 is graph showing the characteristic of an ion-core resonant transformer.

The iron-core resonant transformer 31 has a characteristic as shown in FIG. 7. At the time when the supply voltage is impressed, the output voltage is increased beyond a predetermined level, and after the lapse of about 500 msec. it settles to the predetermined level. This means that the rising of the output voltage takes about 500 msec. and during this period steady voltage fails to be given for a corresponding portion of the light-sensitive medium drum surface. Accordingly, a timing for preventing any image from being produced on this portion is provided.

FIG. 8 shows the function of the charging station 11. As is shown, the first to third charging rollers 20 to 22 in rolling contact with the light-sensitive medium drum 4 in successively spaced-apart positions thereof in the direction of progress apply progressively increasing voltages of $V_0$, 2 $V_0$ and 3 $V_0$ to the drum 4. These voltages give a linear plot having a positive slope and ultimately reaching the same voltage as in the prior art. In the prior art, a sharply rising voltage is applied by a signal charger as shown in FIG. 9.

By putting an original on the original underlay 2 and depressing a copying button (not shown), the aforementioned operations of the individual component parts are obtained, and a copy sheet P having a copied image of the original is discharged to the copy tray 15. In the charging station 11, the drive mechanism 25 is operated with the rotation of the light-sensitive medium drum 4 to cause rotation of the first to third charging rollers 20 to 22 in the direction opposite to the direction of rotation of the drum 4 and at a slightly low peripheral speed with respect thereto. The rollers 20 to 22 are thus rotated in frictional contact with the drum 4 so that uniform contact can be obtained. Also, in the event if defect of part of the rollers 20 to 22 arises (such as contamination by toner), it can be sufficiently made up for by the rest of the rollers. Further, since successively increasing voltages each of which consists of a DC voltage and an AC voltage superimposed thereupon are applied from the power source unit 30 to the respective rollers 20 to 22, as the light-sensitive medium drum 4 is rotated it is progressively charged in a stepwise fashion with the final level provided by the third charging roller 22, and thus required charging can be obtained without the possibility of the flow of excess current. Moreover, since the voltage applied consists of DC and AC superimposed thereupon, it is possible to prevent the effect of space charge and obtain sufficient charging in a short period of time. Still further, residual toner attached to the rollers 20 to 22 is all scraped off by the brushes 28 to eliminate defective charging and charges of the electric resistance.

While in the above embodiments voltages containing DC and AC components superimposed upon each other are applied to all of the first to third charging rollers 20 to 22, this is by means no limitative. For example, it is possible to apply sole DC voltages to the first and second charging rollers 20 and 21 and apply a voltage containing of a DC voltage and an AC voltage corresponding to 20% of the DC to the third charging roller 22.

Figure 11:
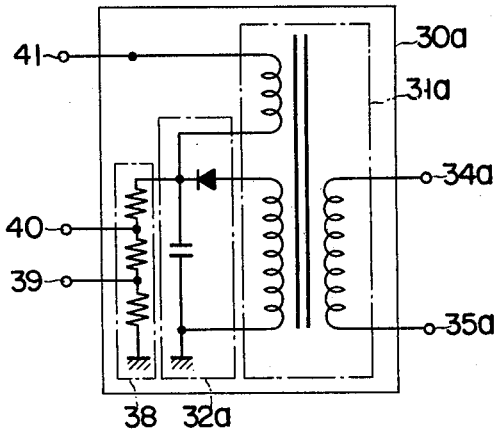
FIG. 11 is a circuit diagram showing the electric circuit of a power source unit constituting the voltage supply means shown in FIG. 10.

FIG. 11 shows a power source unit 30*a* for providing such voltages. It includes an iron-core resonant transformer 31*a*, a rectifying circuit 32*a*, a voltage divider circuit 38 having resistors, input terminals 34*a* and 35*a* and output terminals 39, 40 and 41. Although not shown, the output terminal 39 is electrically connected to first charging roller 20, the output terminal 40 to second charging roller, and the output terminal 41 to the third charging roller 22. In this case and also in the previous embodiment, the AC voltage frequency is effectively in a range between 200 and 600 Hz.

While in the previous embodiment the charging rollers 20 to 22 are rotated at a peripheral speed slightly lower than that of the light-sensitive medium drum 4, this is not a limitation, and they may be rotated at the same peripheral speed as that of the drum as well. In this case, the charging rollers are moved not in frictional contact but in rolling contact with the drum, so that damage will not be readily caused to the surface of the light-sensitive medium 4 even if the medium is a comparatively soft selenium light-sensitive medium.

Further, it is possible to dispense with the drive mechanism 25 for driving the first to third charging rollers 20 to 22 in the previous embodiment; that is, the rollers 20 to 22 may be held urged against the light-sensitive medium drum 4 so that they can be rotated thereby. In this case, i.e., without the drive mechanism, the construction can be simplified, and the cost can be reduced. Further, since the rollers are moved in rolling contact with the drum 4, the surface thereof is less likely to be damaged. Still further, in lieu of the light-sensitive medium drum 4 in the previous embodiment, it is possible to use a planar light-sensitive medium.

Figure 13:
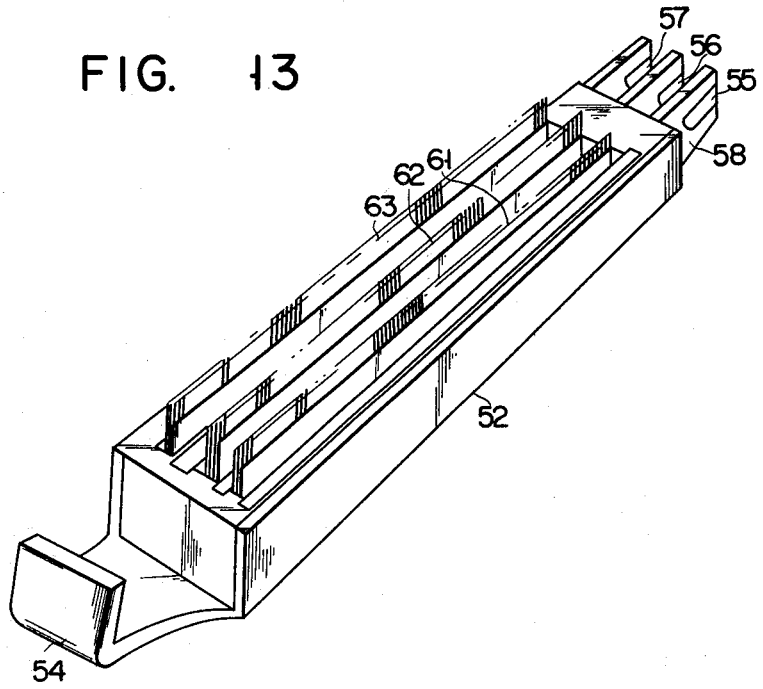
FIG. 13 is a perspective view showing a contact charging section used for the charging station shown in FIG. 12.
Figure 12:
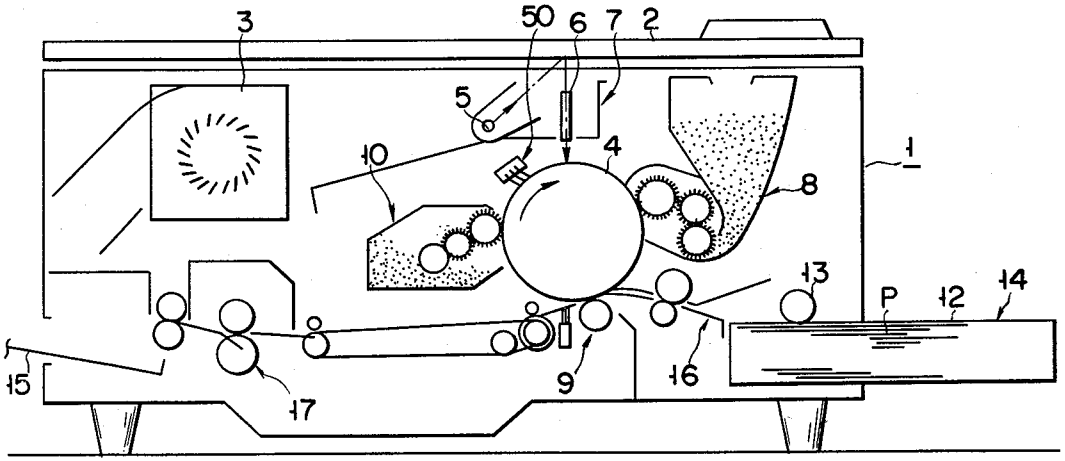
FIG. 12 is a schematic longitudinal sectional view showing an electronic copier incorporating a further embodiment of the invention.
Figure 14:
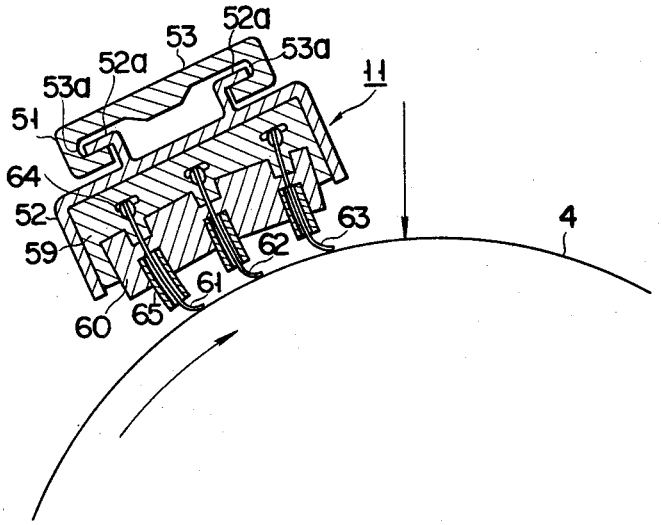
FIG. 14 is a sectional view showing a contact charging section shown in FIG. 13.

Furthermore, while in the previous embodiment the first to third charging rollers 20 to 22 have used as the contact charging elements this is again not limitative. FIGS. 12 through 14 show a modification of the previous embodiment. More particularly, FIG. 12 shows an electronic copier provided with a charging station 50. In FIG. 2, like parts are designated by like reference numerals as in FIG. 1, and their description is omitted. FIGS. 13 and 14 show a contact charging section 51 which is used as the charging station 50. The contact charging section 51 is mounted by removably fitting mounting pieces 52*a* projecting from its case 52, for instance made of aluminum, in mounting grooves 52*a*, 52*a* provided in a support frame 53. The casing 52 has a channel-shaped sectional profile and is provided with an integral handle 54 (FIG. 13) projecting from one end and also with a connector means 58 projecting from the other end and having input terminals 55 to 57. The case 22 accommodates rubber packings 59 and 60 with the latter fitted in the former. First to third charging brushes 61 to 63 which are contact charging elements are mounted in the rubber packings 59 and 60. These charging brushes 61 to 63 are made of a conductive material, for instance carbon fiber (commercially available under a trade name "Toreka"). They are spaced apart by a predetermined interval in the direction of the rotation of light-sensitive medium drum 4, and their tips are adopted to be in frictional contact with the periphery of the drum 4. The tips are bent to be directed in the direction of rotation of the drum 4 and provide for a large contact area. The end of each of the charging brushes 61 to 63 is on the side of the rubber packing 59 bundled by a conductive member and connected to the corresponding one of the input terminals 55 to 57. The charging brushes 61 to 63 are also each clamped in a portion within the rubber packing 60 and a portion projecting therefrom by thin insulating thin plates 65. The thin insulating plates 65 are about 20$\mu$ thick and short of the tip of the individual charging brushes 61 to 63 by about 1.5 mm. They are made of a resin such as "Maira" (a trade name).

Figure 15:
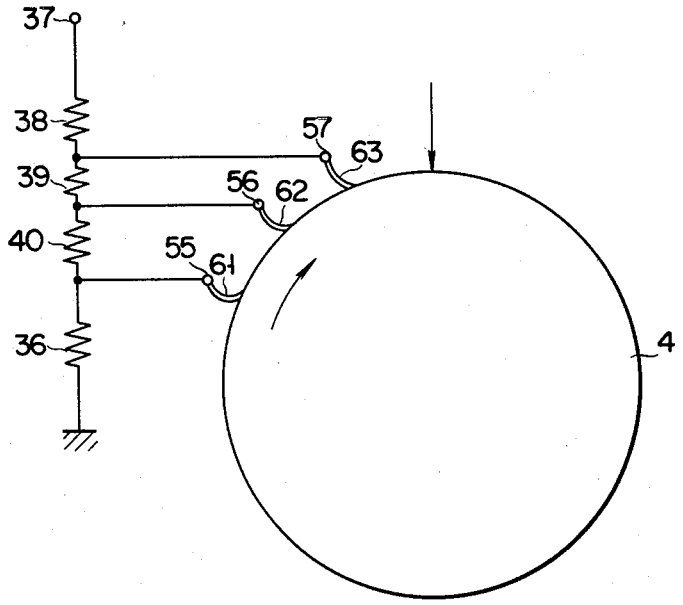
FIG. 15 shows an electric circuit used for applying different voltages to the contact charging section shown in FIG. 13 and also to a contact charging section shown in FIG. 17.

The frame 1 is provided with a power supply section (not shown), and when the case 52 is mounted by holding the handle 54 along the support frame 53, the connector means 58 is coupled to the aforementioned power supply section, with the input terminals 55 to 57 electrically connected to a power source unit 30*a* as shown in FIG. 11. The first to third charging brushes 61 to 63 are electrically connected to output terminal 37 as shown in FIG. 15. More particularly, the output terminal 37 is grounded through a plurality of series resistors 38, 39, 40 and 36, and the input terminals 55 to 57 of the receiving strip 58 are connected to this series resistor circuit. When copying operation is brought about in this state, as the light-sensitive medium drum 4 is rotated successively increasing voltages are applied thereto by the first to third charging brushes 61 to 63. In concrete, the same effects as in the previous embodiment can be obtained with the application of the same voltages as mentioned above. Since the tips of the charging brushes 61 to 63 are bent such that they are directed in the direction of the rotation of the drum 4, sufficient contact area can be ensured even if the uniformity of their length is lacking. Also, the rigidity of the brush can ensure reliable frictional contact with the drum 4. Further, even if some hair of the brush is defective (for instance, has a tendency of being undesirably bent), the defect can be made up for by the other hair. Furthermore, the carbon fiber constituting the charging brushes 61 to 63 offer stable and fixed electric resistance free from fluctuations depending upon the lot and provide strong restoring force even against repeated bending force exerted to it.

At the time of the charging, the thin insulating plates 65 hold the individual charging brushes 61 to 63 from the opposite sides thereof and prevent excessive bending of the brushes. Also, they can prevent the individual brushes from being short-circuited to one another.

Every time when a predetermined number of copies are produced or when a predetermined period is elapsed, the operator can remove toner attached to the charging brushes 61 to 63 by withdrawing the handle 54 of the case 52 from the frame 1.

Figure 18:
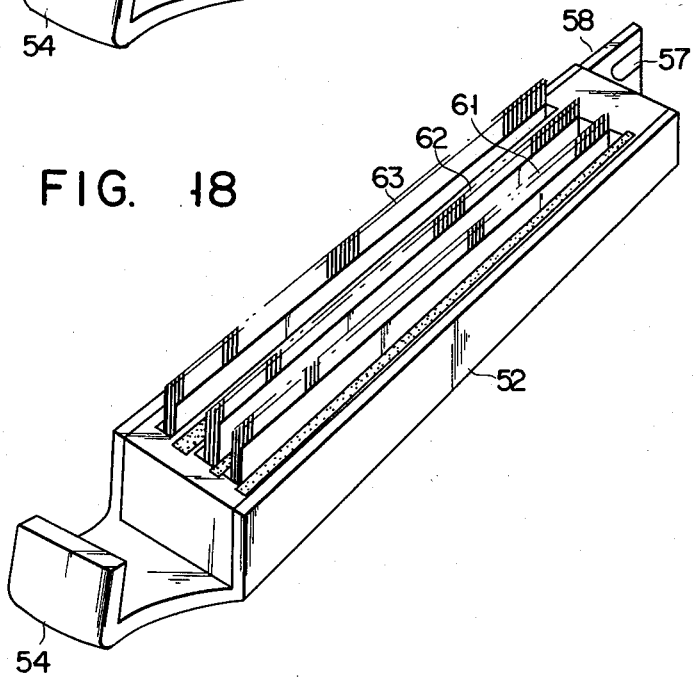
FIG. 18 is a perspective view showing a modified form of the embodiment shown in FIG. 13.

While in this embodiment the receiving strip 58 is provided with the input terminals 55 to 57 connected to the respective charging brushes 61 to 63, it is also possible to provide only a single input terminal 57 for the contact charging section 51 as shown in FIG. 18. This can be achieved by replacing the second rubber packing 60 with a conductive packing made of a conductive rubber material. In this case, the conductive packing can serve as resistors provided between the input terminals of the power source unit 30 or 30*a* and hence permit simplification of the circuit construction. In a specific arrangement, it is possible to supply only a single predetermined voltage to the first charging brush 61, whereby successively increasing voltages are applied to the remaining charging rollers 62 and 63 as in the above embodiment with a charging voltage difference of about 150 V provided. In this case, the current supplied to the light-sensitive medium 4 is about 15 μA, and the resistance of each resistor is about 10 kΩ.

Figure 16:
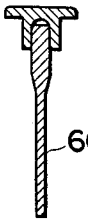
FIG. 16 is a sectional view showing a conductive blade used in a further embodiment of the invention.
Figure 17:
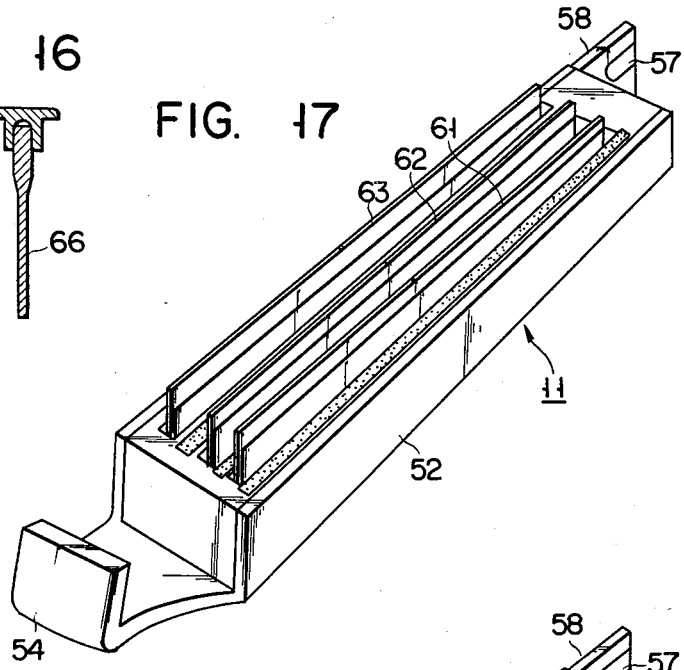
FIG. 17 is a perspective view showing a contact charging section using conductive blades as shown in FIG. 16.

Further, the charging brushes 61 to 63 used as contact charging elements in the above embodiment may be replaced with conductive rubber blades such as one 66 as shown in FIG. 16. In this case, for holding the conductive rubber blades 66 the same construction as shown in FIG. 13 or 17 may be used except for that the charging brushes 61 to 63 shown in FIGS. 13 and 14 are replaced with the conductive rubber blades 66.

In addition, the tips of the conductive rubber blades may be bent and directed in the direction of the rotation of the light-sensitive medium drum 4 like construction of FIG. 14, and also the rubber packing 60 shown in FIGS. 13 and 14 may be replaced with a conductive rubber packing to obtain the same effects as in the aforementioned modification using the charging brushes.

What we claim is:

1. An electronic copier comprising:

a light-sensitive medium, charging means including a plurality of contact charging elements in contact with said light-sensitive medium for charging said medium;

voltage supply means for supplying different voltages to said contact charging elements, the voltages applied to said contact charging elements being made successively higher in accordance with the order of arrangement of the contact charging elements in the direction of movement of said light-sensitive medium;

exposure means for forming an electrostatic latent image on said light-sensitive medium;

means for developing said electrostatic latent image to form a visible image on said light sensitive medium;

means for transferring said visible image formed on said light-sensitive medium onto a recording sheet;

means for fixing the visible image transferred onto said recording sheet, and means for cleaning said light-sensitive medium.

2. An electronic copier according to claim 1, wherein said contact charging elements are charging rollers.

3. An electronic copier according to claim 2, wherein said charging rollers are cleaned by said cleaning means.

4. An electronic copier according to claim 1 or 2, wherein said contact charging elements are conductive blade means.

5. An electronic copier according to claim 4, wherein said conductive blade means have top portions bent in the direction of movement of said light-sensitive medium.

6. An electronic copier according to claim 5, wherein said charging means further includes:

a receiving section, and a case capable of removably mounted in the frame of the electronic copier, and conductive blade means being held within said case, said conductive blade means being electrically connected through said receiving section to said voltage supply means when said case is mounted in said electronic copier frame.

7. An electronic copier according to claim 1, wherein said contact charging elements are charging brushes.

8. An electronic copier according to claim 7, wherein said charging brushes have tips bent in the direction of movement of said light-sensitive medium.

9. An electronic copier according to claim 7, wherein said charging brushes are made of carbon fiber.

10. An electronic copier according to claim 7, wherein said charging means further includes:

a receiving section; and a case capable of being removably mounted in the frame of the electronic copier, said charging brushes being held within said case, said charging brushes being electrically connected through said receiving section to said voltage supply means when said case is mounted in said electronic copier.

11. An electronic copier according to claim 2, wherein said charging rollers are driven by said light-sensitive medium as said light-sensitive medium is moved.

12. An electronic copier according to claim 4, wherein said charging means further includes conductive packing means intervening between adjacent conductive blade means and offering electric resistance such that when a predetermined voltage is applied to one of said conductive blade means from said voltage supply means different voltages are also applied to the other conductive blade means in accordance with the resistance of said conductive packing means.

13. An electronic copier according to claim 7, wherein said charging means further includes conductive packing means intervening between adjacent charging brushes and offering electric resistance such that when a predetermined voltage is applied to one of said charging brushes from said voltage supply means different voltages are also applied to the other charging brushes in accordance with the resistance of said conductive packing means.

14. An electronic copier according to claim 7, wherein said charging means further includes insulating thin plate means clamping said individual charging brushes from the opposite sides thereof except for portions including tips in frictional contact with said light-sensitive medium and holding said individual charging brushes spaced apart from one another.

* * * * *